US008061391B2

(12) United States Patent
Dunleavy

(10) Patent No.: US 8,061,391 B2
(45) Date of Patent: Nov. 22, 2011

(54) 3D COMPOSITE FABRIC

(75) Inventor: Patrick Dunleavy, Palaiseau (FR)

(73) Assignee: Messier-Dowty SA, Velizy Villacoublay (FR)

( * ) Notice: Subject to any disclaimer, the term of this patent is extended or adjusted under 35 U.S.C. 154(b) by 405 days.

(21) Appl. No.: 12/446,002

(22) PCT Filed: Oct. 11, 2007

(86) PCT No.: PCT/FR2007/001659

§ 371 (c)(1),
(2), (4) Date: Apr. 17, 2009

(87) PCT Pub. No.: WO2008/049988

PCT Pub. Date: May 2, 2008

(65) Prior Publication Data

US 2010/0323574 A1 Dec. 23, 2010

(30) Foreign Application Priority Data

Oct. 18, 2006 (FR) ..... 06 09152

(51) Int. Cl.
*D03D 13/00* (2006.01)
*D03D 11/00* (2006.01)
*D03D 25/00* (2006.01)

(52) U.S. Cl. ..... 139/384 R; 139/383 R; 139/387 R; 139/408; 139/420 A; 139/DIG. 1; 442/203; 442/205

(58) Field of Classification Search ..... 139/383 R, 139/384 R, 387 R, 408, 420 A, DIG. 1; 442/203, 442/205

See application file for complete search history.

(56) References Cited

U.S. PATENT DOCUMENTS

| | | | | | |
|---|---|---|---|---|---|
| 870,697 | A * | 11/1907 | Stevenson | 139/408 |
| 2,899,987 | A * | 8/1959 | Finken et al. | 139/408 |
| 2,929,412 | A * | 3/1960 | Abendroth | 139/385.5 |
| 3,749,138 | A * | 7/1973 | Rheaume et al. | 139/408 |
| 4,312,913 | A * | 1/1982 | Rheaume | 442/187 |
| 4,554,953 | A * | 11/1985 | Borel et al. | 139/383 A |
| 4,668,545 | A * | 5/1987 | Lowe | 428/35.1 |
| 4,848,414 | A * | 7/1989 | Cahuzac | 139/411 |
| 4,853,269 | A * | 8/1989 | Fukumori et al. | 428/43 |
| 4,922,969 | A * | 5/1990 | Campman et al. | 139/408 |
| 4,958,663 | A * | 9/1990 | Miller et al. | 139/384 R |
| 5,021,283 | A * | 6/1991 | Takenaka et al. | 428/116 |
| 5,080,142 | A * | 1/1992 | Calamito et al. | 139/384 R |
| 5,465,760 | A * | 11/1995 | Mohamed et al. | 139/11 |
| 5,899,241 | A * | 5/1999 | David et al. | 139/408 |
| 6,418,973 | B1 * | 7/2002 | Cox et al. | 139/383 R |
| 6,555,488 | B1 * | 4/2003 | Qiu et al. | 442/205 |
| 6,668,868 | B2 * | 12/2003 | Howland et al. | 139/383 R |

(Continued)

FOREIGN PATENT DOCUMENTS

EP 0856601 A1 8/1998

(Continued)

*Primary Examiner* — Bobby Muromoto, Jr.
(74) *Attorney, Agent, or Firm* — Sughrue Mion, PLLC

(57) ABSTRACT

A fabric includes a base pattern having at least twenty-eight weft fibers disposed in a staggered configuration and forming eight columns that comprise in alteration four weft fibers and three weft fibers, the weft fibers extending in seven layers. The fabric further includes at least twelve warp fibers disposed in at least four offset parallel planes, each of the planes containing at least three parallel warp fibers that follow paths that are distinct from one another.

4 Claims, 1 Drawing Sheet

U.S. PATENT DOCUMENTS

| | | | | |
|---|---|---|---|---|
| 7,601,288 | B2 * | 10/2009 | Dunleavy | 264/258 |
| 7,704,429 | B2 * | 4/2010 | Dunleavy | 264/258 |
| 7,960,298 | B2 * | 6/2011 | Goering | 442/205 |
| 2007/0137778 | A1 * | 6/2007 | Dunleavy | 156/256 |
| 2007/0232171 | A1 * | 10/2007 | Maki et al. | 442/205 |
| 2009/0186547 | A1 * | 7/2009 | Coupe et al. | 442/205 |
| 2009/0214815 | A1 * | 8/2009 | Okada | 428/107 |
| 2009/0223588 | A1 * | 9/2009 | Dunleavy | 139/384 R |
| 2010/0183836 | A1 * | 7/2010 | Wangenheim | 428/36.1 |
| 2010/0275764 | A1 * | 11/2010 | Egres, Jr. | 89/36.02 |

FOREIGN PATENT DOCUMENTS

| | | | |
|---|---|---|---|
| EP | 1526285 | | 4/2005 |
| FR | 2610951 | A1 | 8/1988 |
| WO | 90/12911 | A | 11/1990 |

* cited by examiner

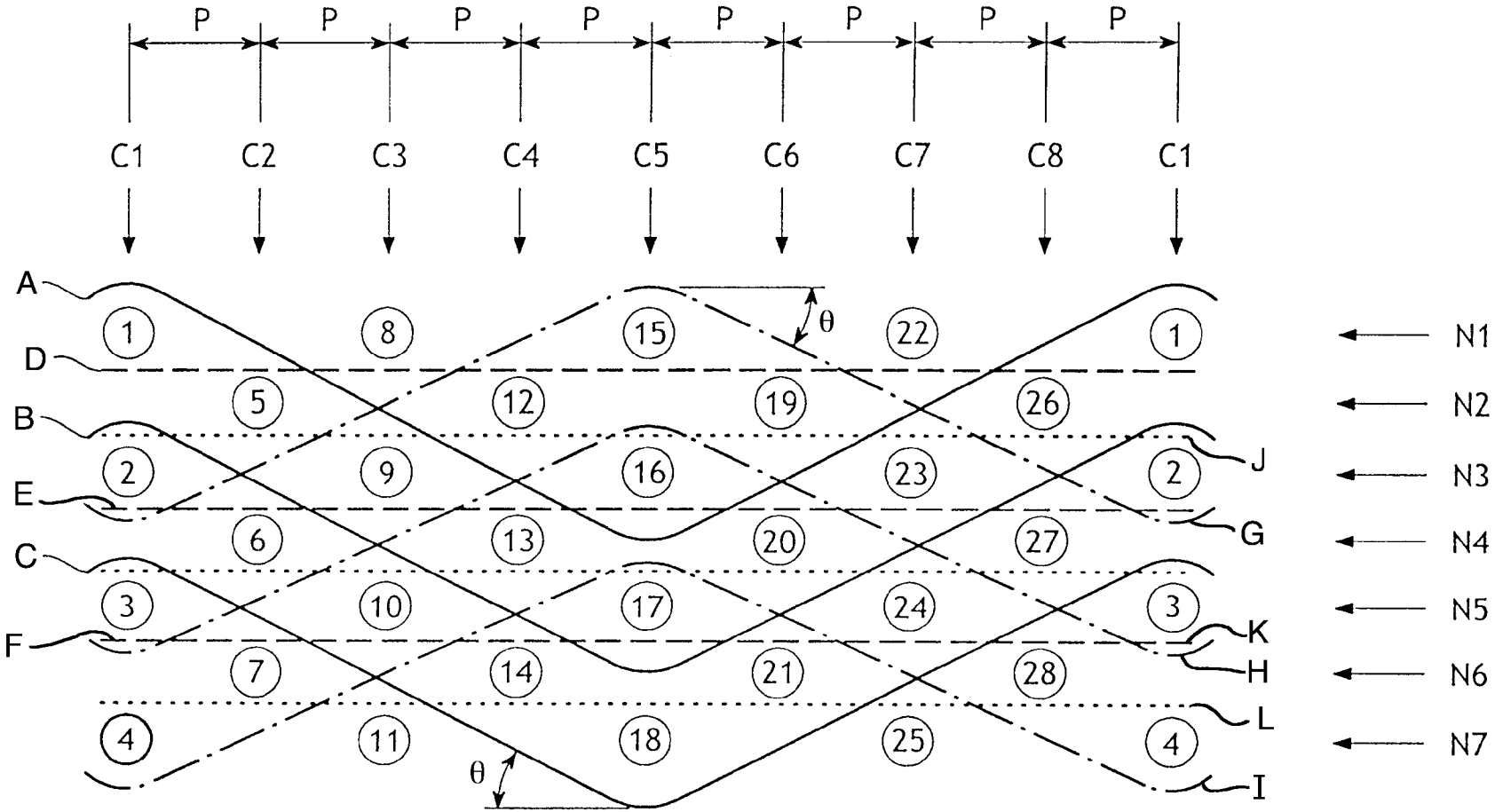
N1
N2
N3
N4
N5
N6
N7
C1
C2
C3
C4
C5
C6
C7
C8
C1
P
P
P
P
P
P
P
A
B
C
D
E
F
G
H
I
J
K
L
θ
θ
1
2
3
4
5
6
7
8
9
10
11
12
13
14
15
16
17
18
19
20
21
22
23
24
25
26
27
28

3D COMPOSITE FABRIC

CROSS-REFERENCE TO RELATED APPLICATIONS

This application is entitled to the benefit of and incorporates by reference essential subject matter disclosed in International Application No. PCT/FR2007/001659 filed on Oct. 11, 2007 and French Patent Application No. 0609152 filed on Oct. 18, 2006.

FIELD OF THE INVENTION

The invention relates to a 3D composite fabric.

BACKGROUND OF THE INVENTION

The present invention relates to a fabric with an optimized weave of the multiple-linked ply type that is suitable for use in producing composite material parts that are highly stressed in tension, compression, or bending, and/or that are subjected to impacts. Such parts include, for example, the stays, rods, and struts of landing gear.

Textile structures are known that are referred to as 1D or 2D structures, depending on whether their fibers extend in one direction only or in two different directions. In general, such structures do not make it possible to withstand the above-mentioned stresses effectively. So-called 3D structures that comprise fibers extending in three distinct directions in three-dimensional space are better at withstanding said stresses. So-called 4D, 5D, 9D, 11D, . . . structures are known to exist that comprise fibers extending in a larger number of distinct directions, but those structures are very complex and it is difficult to automate production thereof.

The invention thus relates more particularly to 3D textile structures.

These structures include 3D structures having a plurality of layers linked together by stitching. These structures are known to present good linearity when the weft fibers are bent, and they offer the advantage of including reinforcement. However, that method of linking does not impart good impact resistance to a part produced from such a fabric.

Multi-ply fabrics that are linked together by weaving are also known, with the orthogonal type 3D fabric (in which the ply-linking fibers extend substantially orthogonally to the plies) being the fabric that presents the best linearity for the weft fibers and the warp fibers (i.e. paths with small linking angles or small amounts of curvature), thereby withstanding compression well. Nevertheless, in order to ensure that such fabrics present an advantageous fiber volume fraction, it needs to be compressed, such that the yarns that are orthogonal to the plies and that serve to connect them to one another acquire large amounts of curvature, giving them highly undulating paths that are thus not very linear, which means that they cannot contribute effectively to transferring forces.

Although non-orthogonal 3D fabrics are more advantageous in this respect, they nevertheless suffer from the drawback of presenting linking fibers having linking angles or amounts of curvature that are too great, regardless of whether the weave of the fabric is simple, of the multi-ply taffeta, satin, or serge type, or the weave is more elaborate, such as the 3X type weave.

The fabric known as "2.5D" fabric, described in document FR 2610951, is particularly optimized and presents little expansion and a high percentage of surface occupation, but at the price of poor linearity (i.e. at least some of the fibers present large amounts of curvature or large linking angles).

The definition of that fabric gives it angle characteristics that are harmful to withstanding impacts and limits reversible textile structures (i.e. structures obtained by turning the weave through 90°) to structures of low density, unless large numbers of additional plies are added, which makes automatic fabrication difficult.

The fabric described in document U.S. Pat. No. 5,899,241 is particularly optimized for withstanding impacts. Nevertheless, the high degree of interlacing between the plies limits the compression strength of an element made from such a fabric.

SUMMARY OF THE INVENTION

The invention provides a method of weaving an optimized 3D fabric presenting good ability to withstand impacts in particular, while being easily deformable.

DETAILED DESCRIPTION OF THE PREFERRED EMBODIMENT

The invention is described directly with reference to the sole accompanying FIGURE showing a base pattern of the fabric in a particular embodiment of the invention, in which the weft fibers are shown end-on and the warp fibers extend in planes parallel to the plane of the FIGURE. Here the fabric comprises a base pattern comprising:

- at least twenty-eight weft fibers (seen end-on), numbered 1 to 28, disposed in a staggered configuration and forming eight columns C1 . . . C8 that extend perpendicularly to a thickness direction of the fabric, and that comprise in alternation four weft fibers and three weft fibers, being separated by a common predetermined space P, the weft fibers occupying seven levels N1 . . . N7 that extend transversely to the columns. Thus, the first, third, fifth, and seventh columns C1, C3, C5, and C7 have four weft fibers extending respectively in levels N1, N3, N5, and N7, while the second, fourth, sixth, and eighth columns C2, C4, C6, and C8 have three weft fibers extending respectively in levels N2, N4, and N6;
- at least twelve warp fibers A . . . L disposed in at least four parallel planes extending transversely relative to the weft fibers, each of these planes containing at least three parallel warp fibers disposed one above the other in the following manner.

In a first plane that coincides with the plane of the figure, the warp fibers under consideration A, B, and C are represented by continuous lines. The warp fiber A passes over the first weft fiber 1 of the first column C1, passes under the second weft fiber 16 of the fifth column C5, and passes over the first weft fiber 1 of the first column C1 of the following pattern. In the same plane, the weft fiber B and the weft fiber C are parallel to the weft fiber A, but they are offset in the thickness direction of the fabric, each time by one weft fiber.

In a second plane that is here located behind the first plane, the warp fibers are substantially parallel to the levels N1 . . . N7 and they are represented by dashed lines. The warp fiber D passes over the first weft fiber 5 of the second column C2, under the first weft fiber 8 of the third column C3, over the first weft fiber 13 of the fourth column C4, and so on. The warp fibers E and F follow parallel paths, being offset each time by one weft fiber in a direction parallel to the columns;

- in a third plane that here is behind the second plane, the warp fibers G, H, I are represented by chain-doted lines. They follow paths parallel to those of the warp fibers A, B, and C of the first plane, but they are offset laterally by four columns in a direction parallel to the levels; and finally in a fourth plane, which here is behind the third plane, the warp fibers J, K, and L are represented by dotted lines. They are parallel to the warp fibers D, E, and F, but they are offset in the thickness direction of the fabric such that the warp fiber J passes under the first weft fiber 5 of the second column, the warp fiber K passes under the weft fiber 6 of the same column, and the warp fiber L passes under the weft fiber 7 of the same column.

This disposition offers several advantages:

it makes it possible to obtain a multi-ply structure with a degree of linking that is suitable for providing good resistance to delamination, and thus better resistance to impacts and to compression, while preserving good deformability;

the fabric can be made not only from carbon fibers, but also from glass fibers, aramid fibers, or indeed silica-containing fibers or ceramic fibers. It advantageously constitutes a preform suitable for being impregnated with resin e.g. by the resin transfer molding (RTM) method once the preform has been shaped in a mold or using some other method;

the fabric enables weaving to be performed automatically using fibers that have high-grade mechanical performance (e.g. carbon fibers with a high modulus of elasticity), but that are fragile in weaving. It is even possible to use carbon fibers of considerable density per unit length, such as fibers weighing 48 kilofilaments to 96 kilofilaments, or even more;

the fabric obtained in this way presents a large fiber volume fraction, here equal to at least 57%;

the disposition of the warp fibers in a plurality of offset planes gives rise to linking angles q that are fairly small, in practice less than or equal to 15°, thereby giving the warp fibers and the weft fibers very good linearity that enables the fibers to be made to work more effectively in compression;

this disposition makes it possible to have the proportion of warp fibers out of balance relative to the proportion of weft fibers in order to compensate for the non-linearity of the weft fibers (e.g. 70% weft fibers and 30% warp fibers); and finally this disposition can be reversed (turning the weave through 90°) to improve linearity.

The invention is not limited to the above description, but on the contrary covers any variant coming within the ambit defined by the claims.

In particular, the base pattern of the weave described herein can easily be extended both in the thickness direction of the fabric (thus in the column direction), and in the lateral direction (thus in the direction of the levels).

What is claimed is:

1. A fabric of woven yarns or fibers comprising weft fibers and warp fibers disposed in a weave having a base pattern that comprises:

at least twenty-eight weft fibers (1 . . . 28), disposed in a staggered configuration and forming eight parallel columns (C1 . . . C8), in which each of the first, third, fifth, and seventh columns has four weft fibers and each of the second, fourth, sixth, and eighth columns has three weft fibers, the columns being separated by a common predetermined space (P), and the weft fibers extending in seven levels (N1 . . . N7) that extend transversely to the columns;

at least twelve warp fibers (A . . . L) disposed in at least four parallel planes extending transversely to the weft fibers and offset from one another, each of these planes containing at least three parallel warp fibers disposed one above another as follows:

in a first plane, a first warp fiber (A) passes over the first weft fiber (1) of the first column (C1), passes under the second weft fiber (16) of the fifth column (C5), and then passes over the first weft fiber (1) of the first column (C1) of the following pattern; the second and third warp fibers (B, C) extending in said first plane parallel to the first weft fiber (A), being offset on each occasion by one weft fiber in a direction parallel to the columns;

in a second plane, a first warp fiber (D) extends substantially parallel to the levels (N1 . . . N7) passes over the first weft fiber (5) of the columns (C2, C4, C6, C8) having three weft fibers, and under the first weft fiber of the columns (C1, C3, C5, C7) having four weft fibers; the second and third warp fibers (E, F) extending parallel to the first warp fiber (D), being offset on each occasion by one weft fiber in a direction parallel to the columns;

in a third plane, the three the warp fibers concerned (G, H, I) extend parallel to the warp fibers (A, B, C) of the first plane, being offset laterally by four columns in a direction parallel to the levels; and finally in a fourth plane, the three warp fibers (J, K, L) concerned extend parallel to the warp fibers (D, E, F) of the second plane, being offset in a direction parallel to the columns in such a manner that they pass under the weft fibers of the columns (C2, C4, C6, C8) having three weft fibers.

2. A fabric according to claim 1, having a fiber volume fraction of not less than 57%.

3. A fabric according to claim 1, wherein the fibers have linking angles (q) less than or equal to 15°.

4. A part obtained from the fabric of claim 1.

* * * * *